US008516640B2

(12) United States Patent
Merten et al.

(10) Patent No.: US 8,516,640 B2
(45) Date of Patent: Aug. 27, 2013

(54) SOCKET SYSTEM

(75) Inventors: David J. Merten, Manitowoc, WI (US); Jay Z. Muchin, Manitowoc, WI (US); Michael S. Potempa, Freeport, IL (US); Brian S. Potempa, Freeport, IL (US)

(73) Assignee: M Group, Inc., Manitowoc, WI (US)

( * ) Notice: Subject to any disclaimer, the term of this patent is extended or adjusted under 35 U.S.C. 154(b) by 269 days.

(21) Appl. No.: 12/984,526

(22) Filed: Jan. 4, 2011

(65) Prior Publication Data

US 2011/0162149 A1 Jul. 7, 2011

Related U.S. Application Data

(60) Provisional application No. 61/292,083, filed on Jan. 4, 2010.

(51) Int. Cl.
*B25F 1/04* (2006.01)
*B25B 13/06* (2006.01)

(52) U.S. Cl.
USPC ..... 7/119; 81/124.4; 7/138; 7/118

(58) Field of Classification Search
USPC ..... 81/121.1, 124.4, 124.5, 125.1, 124.6, 81/124.7; 7/100, 118, 119, 138
See application file for complete search history.

(56) References Cited

U.S. PATENT DOCUMENTS

| | | | | | |
|---|---|---|---|---|---|
| 1,281,438 | A * | 10/1918 | Tuttle | 81/124.5 |
| 1,395,528 | A * | 11/1921 | Silva | 81/124.5 |
| 1,497,963 | A * | 6/1924 | Unfried | 7/100 |
| 1,500,852 | A * | 7/1924 | Shephard | 7/100 |
| 1,571,580 | A * | 2/1926 | Fishburn | 81/124.3 |
| 3,680,159 | A * | 8/1972 | Wharram | 7/100 |
| 4,291,426 | A * | 9/1981 | Bishop, Jr. | 7/100 |
| 4,459,716 | A * | 7/1984 | Valadez | 7/100 |
| 4,578,835 | A * | 4/1986 | Pichler et al. | 7/168 |
| 4,589,153 | A * | 5/1986 | Paquette | 7/169 |
| 4,840,094 | A * | 6/1989 | Macor | 81/185 |
| 4,882,958 | A * | 11/1989 | McNeeley | 81/124.4 |
| 5,107,560 | A * | 4/1992 | Hulsey | 7/163 |
| 5,285,543 | A * | 2/1994 | Rowe | 7/138 |
| 5,553,340 | A * | 9/1996 | Brown, Jr. | 7/118 |
| 5,787,535 | A * | 8/1998 | Epstein | 7/118 |
| 6,109,142 | A * | 8/2000 | Learng | 81/124.5 |
| 6,182,537 | B1 * | 2/2001 | Vasichek et al. | 81/125 |
| 6,314,841 | B1 * | 11/2001 | Burk et al. | 81/125.1 |
| 6,354,176 | B1 * | 3/2002 | Nordlin | 81/124.4 |
| 6,418,821 | B1 * | 7/2002 | Yamakawa | 81/437 |
| 6,748,828 | B2 * | 6/2004 | Bollinger | 81/177.2 |
| 7,036,401 | B2 * | 5/2006 | Carroll | 81/177.2 |
| 7,290,467 | B2 * | 11/2007 | Harker | 81/125 |
| 7,334,506 | B2 * | 2/2008 | Hui | 81/124.4 |
| 7,340,984 | B2 * | 3/2008 | Hsieh | 81/177.85 |
| 7,926,393 | B2 * | 4/2011 | Hart | 81/124.4 |
| 2002/0011135 | A1 * | 1/2002 | Hall | 81/124.4 |
| 2006/0117915 | A1 * | 6/2006 | Hui | 81/124.4 |
| 2008/0066584 | A1 * | 3/2008 | Vines | 81/124.2 |
| 2008/0105093 | A1 * | 5/2008 | Hart | 81/124.3 |
| 2010/0282029 | A1 * | 11/2010 | Hsieh | 81/121.1 |

OTHER PUBLICATIONS

Photos of existing spark plug tools as of Jan. 3, 2011.

* cited by examiner

*Primary Examiner* — David B Thomas
(74) *Attorney, Agent, or Firm* — Rathe Lindenbaum LLP

(57) ABSTRACT

A socket system includes a socket having a first end and a second end. The first end has a first socket opening having a first inner configuration. The second end has a second socket opening having a second inner configuration different than the first inner configuration.

23 Claims, 21 Drawing Sheets

SOCKET SYSTEM

CROSS-REFERENCE TO RELATED PATENT APPLICATIONS

The present application claims priority under 35 USC 119 from U.S. Provisional Application Ser. No. 61/292,083 filed on Jan. 4, 2010 by David J. Merten, Jay Z. Muchin, Michael M. Potempa and Brian S. Potempa, and entitled SOCKET SYSTEM, the full disclosure of which is hereby incorporated by reference.

BACKGROUND

Sockets are used to insert and remove various nuts, bolts and other items such as spark plugs. Identifying and obtaining the correct socket for different projects or different spark plugs is often inconvenient and difficult.

DETAILED DESCRIPTION OF THE EXAMPLE EMBODIMENTS

Figure 1:
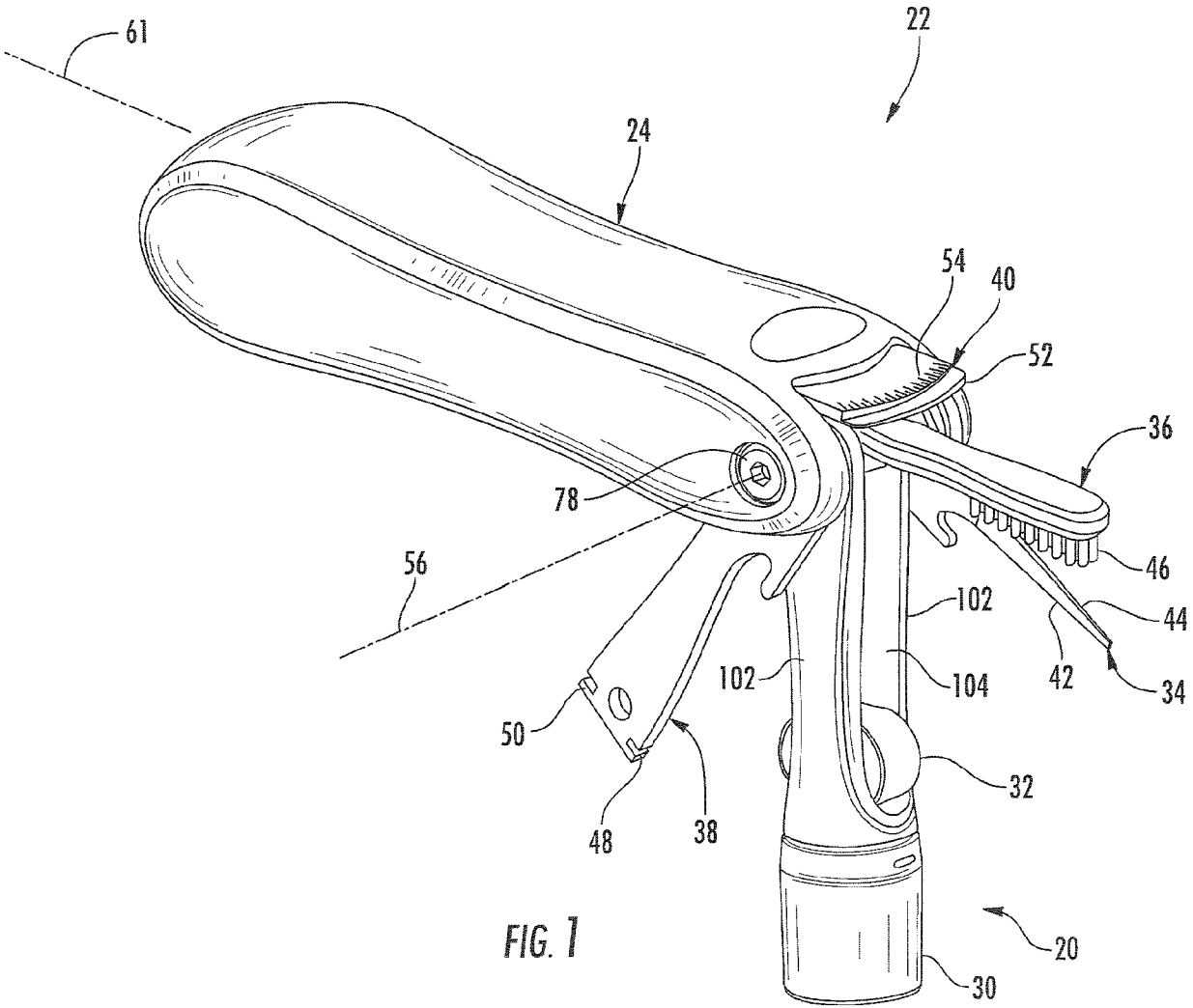
FIG. 1 is a perspective view of a spark plug tool including a socket system according to an example embodiment.

FIG. 1 is a perspective view illustrating a socket system 20 integrated as part of a spark plug tool 22 according to an example embodiment. As will be described hereafter, socket system 20 provides multiple differently configured socket openings with a single removable socket. This single socket and its associated extension conveniently nest within a handle. When integrated as part of the spark plug tool 22, socket system 20 may accommodate differently sized spark plugs. At the same time, spark plug tool 22 provides multiple other nesting spark plug implements for inspecting, adjusting, tuning and servicing spark plugs. In yet other embodiments, socket system 20 may be incorporated as part of other tools not necessarily configured for spark plug removal, installation, service and maintenance.

Figure 2:
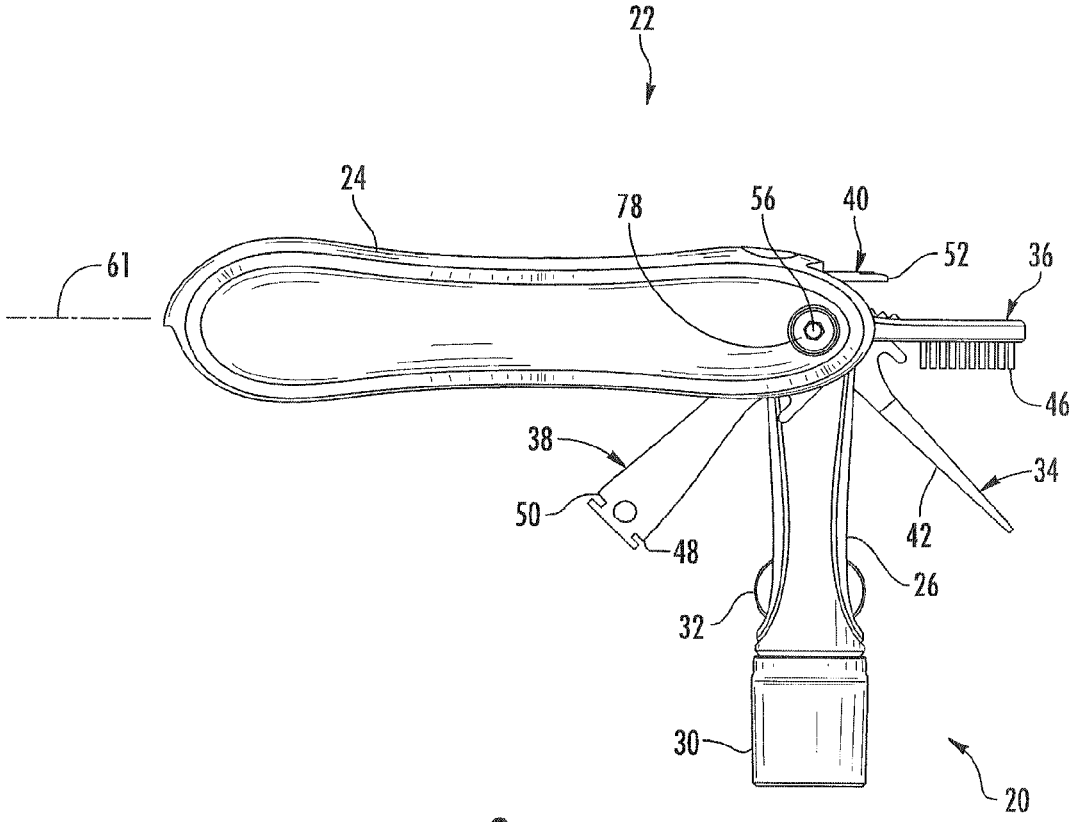
FIG. 2 is a side elevational view of the spark plug tool and socket system of FIG. 1.

As shown by FIGS. 1 and 2, socket system 20 includes handle 24, extension 26, socket mount 28 (shown in FIG. 7), socket 30 and socket retainer 32. In addition to socket system 20, spark park plug tool 22 includes additional spark plug implements or devices such as scraper 34, brush 36, and gap gauge 40. Scraper 34, brush 36 and gapping gauge 40 facilitate the inspection, adjustment, tuning and servicing of a spark plug. Scraper 34 includes an edge 42 and a serrated or roughened face 44 to assist in the removal of carbon. Brush 36 includes metal or brass wires 46 to facilitate the cleaning of electrodes and threads. Adjuster 38 includes differently sized notches 48, 50, each notch sized for receiving a differently sized ground electrode and for bending and repositioning the ground electrode with respect to an opposite center electrode of the spark plug so as to adjust the gap between the ground electrode and the center electrode. Gap gauge 40 comprises a coin-style gauge having an edge 52 that continuously and smoothly becomes thicker from a first end to an opposite second end with associated thickness identifying markings 54. In other embodiments, other spark plug implements may be provided as part of spark plug tool 22. For example, in place of a coin style gap gauge 40, spark plug tool 22 may alternatively include one or more wire gauges or other gauging mechanisms. In still other embodiments, one or more of such spark plug implements may be omitted.

Handle 24 supports the remainder of socket system 20 as well as the one or more socket implements described above. In the example illustrated, handle 24 pivotally supports extension 26 and each of scraper 34, brush 36 and gap adjuster 38 for rotation or pivotal movement about axis 56 between extended positions shown in FIGS. 1-4 and nested positions shown in FIGS. 5 and 6. Although extension 26 and implements 34-38 are illustrated in particular and the other positions about axis 56 for purposes of concurrently illustrating all of such importance, extension 26 and each of such implements 34-38 may be pivoted about axis 56 at any variety of different independent angles with respect to handle 24.

In addition to pivotally supporting extension 26 and implements 34-38, handle 24 additionally receives and partially encloses gap gauge 40. Gauge 40 is slidably supported by handle 24 for movement along axis 61, substantially perpendicular to axis 56, between a retracted position (shown in FIG. 1) and an extended position. In the extended position, gap gauge 40 projects or extends from housing 24 to a greater extent as compared to the retracted position shown in FIG. 1. As a result, gauge 40 may be extended when being used and retracted out of the way when not being used.

Figure 7:
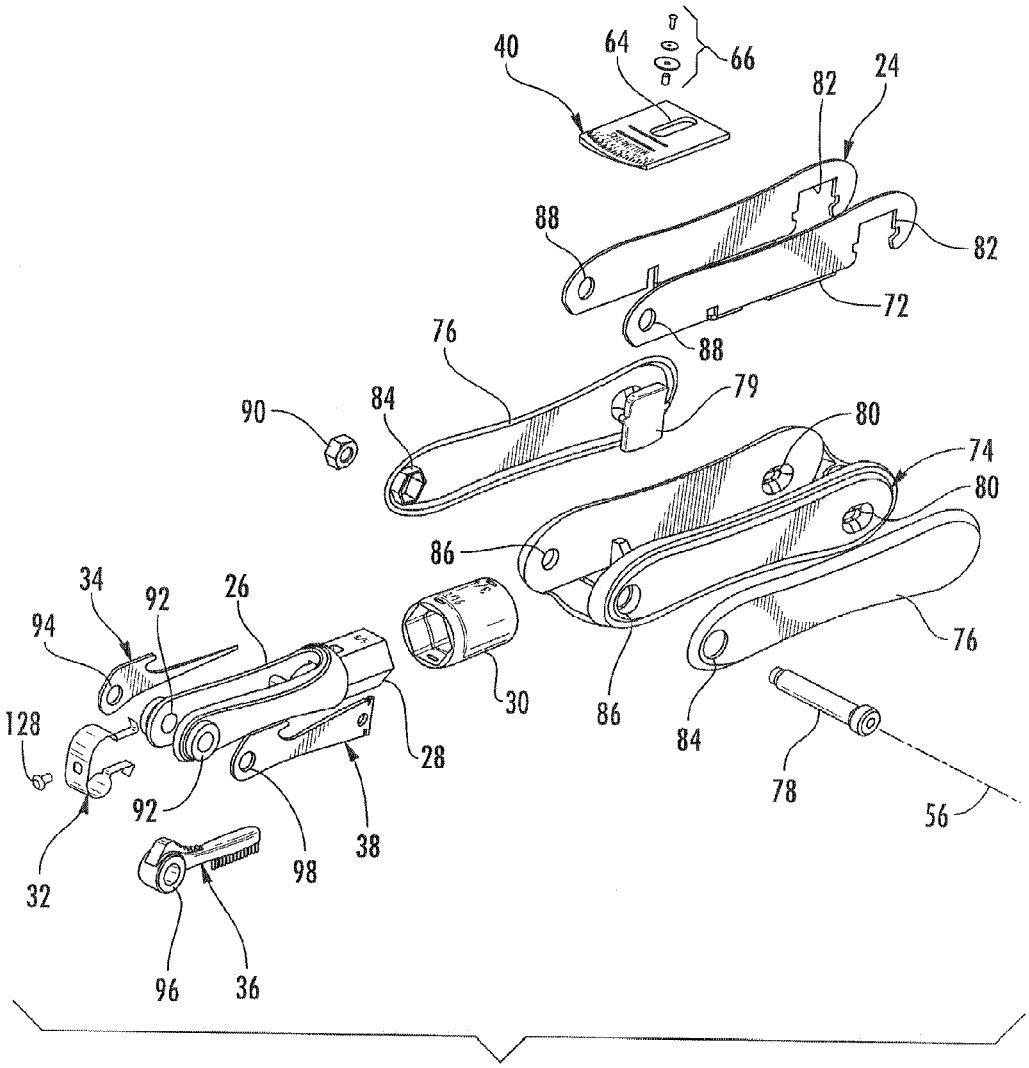
FIG. 7 is an exploded perspective view of the spark plug tool and socket system.

As shown by FIG. 7, gap gauge 40 includes elongate slot 64 through which a fasting arrangement 66 extends to join gap gauge 40 to handle 24. Fastening arrangement 66 slides within slot 64 to facilitate sliding movement of gap gauge 40 with respect to handle 24. In other embodiments, gap gauge 40 may be slidably supported and retained relative to handle 24 with other mechanisms or in other fashions. It still other embodiments, gap gauge 40 may alternatively be pivotally connected to handle 24 in a fashion similar to the other spark plug implements. For example, multiple wire gap gauges may alternatively be pivotally coupled to handle 24 for pivotal movement about axis 56.

Figure 3:
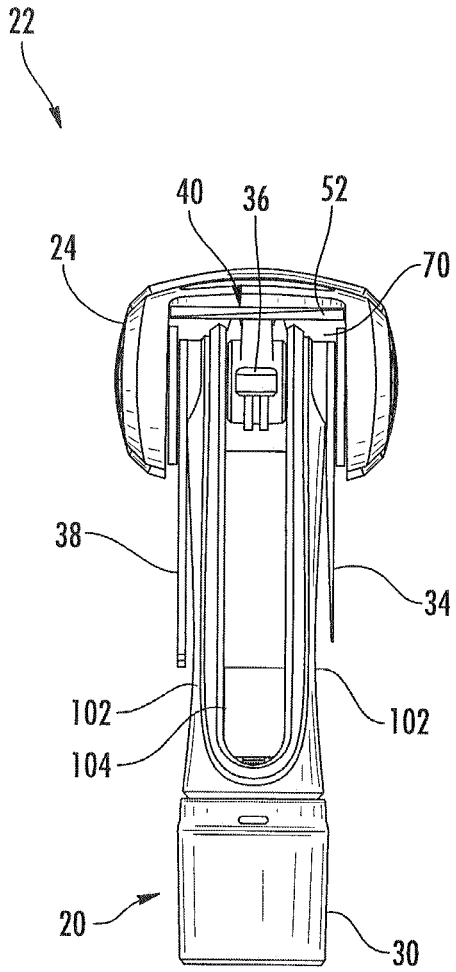
FIG. 3 is a rear elevational view of the spark plug tool and socket system of FIG. 1.
Figure 6:
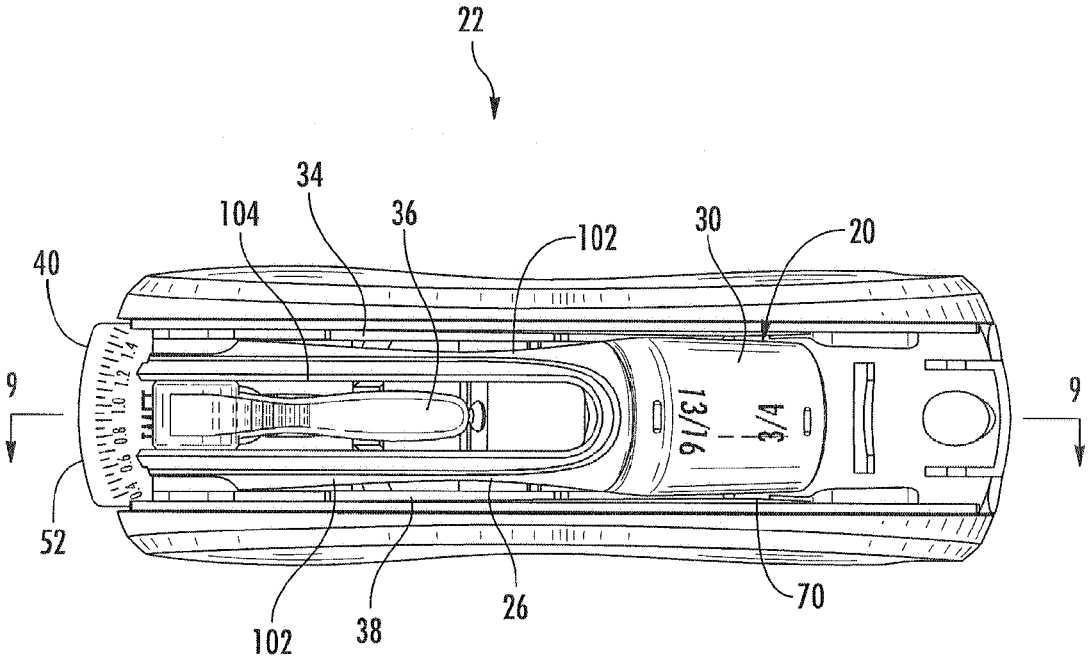
FIG. 6 is a bottom plan view of the spark plug tool and socket system in a closed state.

As shown in FIGS. 3 and 6, in the example embodiment illustrated, handle 24 includes an interior cavity 70 into which extension 26 and implements 34-38 nest. As shown by FIG. 7, handle 24 includes a rigid core 72, an outer body 74, a pair of opposite grip panels 76 and a pivot rod, shaft or bolt 78. Core 72 fits within body 74 and is secured within body 74 by fasteners, such as rivets, or in other matters such as by bonding or welding. In the example illustrated, core 72 is formed from stamped and deformed metal.

Outer body 74 extends about core 72 and supports side panels 76. In the example illustrated, Outer body 74 is formed from one or more polymer materials. Side panels 76 or formed from one or more elastomeric or soft rubber-like materials, such as SANTOPRENE by Dupont. Side panels 76 each include flaps or catches 79 which extend through apertures 80 in body 74 and through openings 82 in core 24 so as to be held and retained against outer sides of body 74. Side panels 76 provide a soft, comfortable surface to facilitate secure gripping of handle 24.

Pivot bolt 78 extends through aligned apertures 84 insight panels 76, 86 in housing 74 and 88 in core 24. Pivot bolt 78 is secured in place with a locknut 90 threaded on to an end of bolt 78. Pivot bolt 78 further extends through apertures 92 of extension 26, through aperture 94 of scraper 34, through aperture 96 of brush 36 and through aperture 98 of gap adjuster 38. As a result, pivot bolt 78 daily supports extension 26 and each of spark plug implements 34-38 about axis 56 provide by 78.

FIG. 7 illustrates just one example embodiment of handle 24. In other embodiments, handle 24 may have numerous other configurations. For example, in other embodiments, one or more of core 24 or side panels 76 may be omitted, may be formed from other materials or may be joined to one another in other fashions. Pivot bolt 78 may be secured to the remainder of handle 24 in other fashions and may comprise other structures for pivotally supporting extension 26 and implements 34-38.

Figure 4:
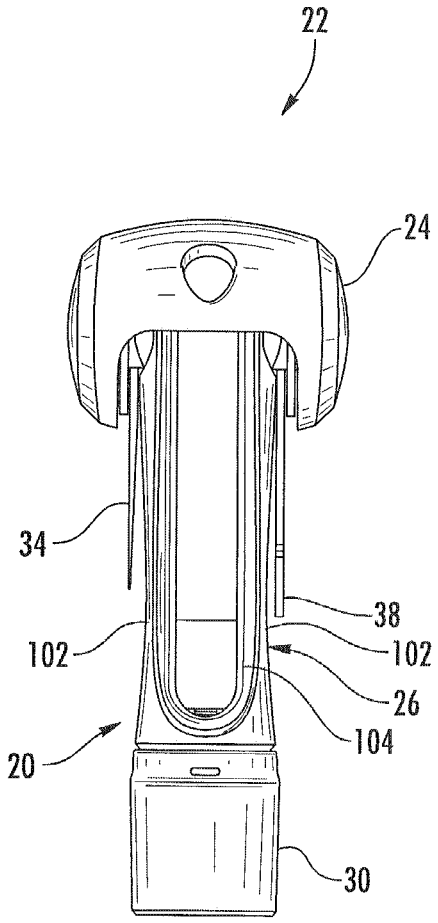
FIG. 4 is a front elevational view of the spark plug tool and socket system of FIG. 1.
Figure 5:
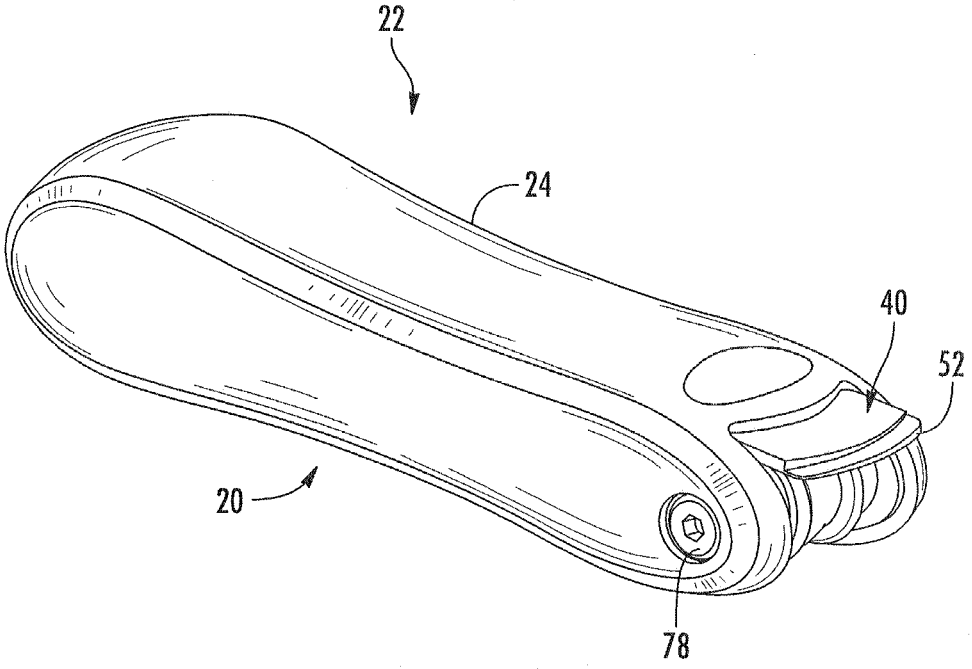
FIG. 5 is a perspective view of the spark plug tool and socket system in a closed state.

As shown by FIGS. 3 and 4, extension 26 of socket system 20 extends between handle 24 and socket remote 28. In the example illustrated, extension 26 comprises a pair of spaced apart arms 102 which form an interior cavity 104. As shown by FIG. 6, cavity 104 receives at least one of spark plug implements 34-38, allowing the one or more spark plug implements 34-38 nest within extension 26 as well as within handle 24. As a result, spark plug tool 22 is even more compact. In the example illustrated, brush 36 is nested within cavity 104 while scraper 34 is to one side of extension 26 and gap adjuster 38 is to another side of extension 26. In other embodiments, other spark plug implements or additional spark plug implements may nest within cavity 104. In yet other embodiments, cavity 104 may have other configurations. For example, in other embodiments, a panel may bridge between and across arms 102 such that cavity 104 is enclosed on three sides. In yet other embodiments, extension 26 may omit cavity 104 and may alternatively extend to one side or another side of each of implements 34-38.

Figure 8:
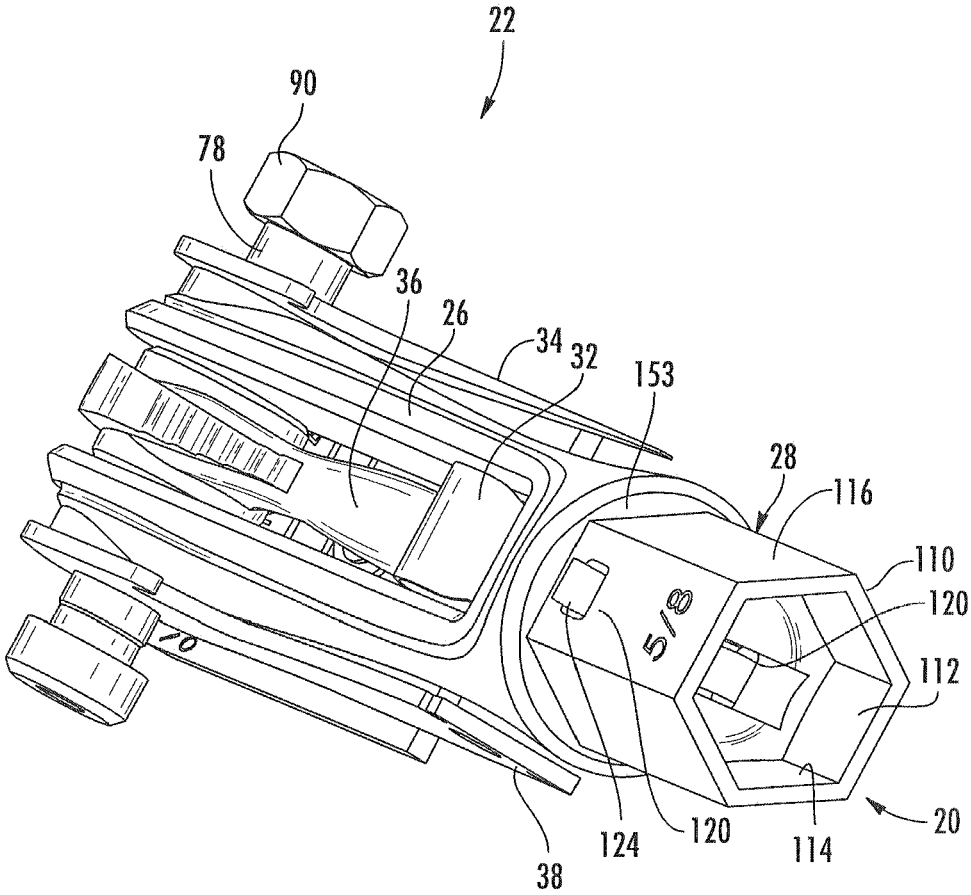
FIG. 8 is a perspective view of the spark plug tool and socket system of FIG. 1 with portions omitted for purposes of illustration.

FIG. 8 illustrates spark plug tool 22 without socket 30 and without handle 24 but for pivot bolt 78. As shown by FIG. 8, socket mount 28 extends from the end of extension 26 and includes one or walls 110 forming a socket opening 112. Walls 110 have an inner configuration 114 defining the socket opening 112 and an outer configuration 116 corresponding to an inner configuration of a socket opening of socket 30. In the example illustrated, inner configuration 114 has a hexagonal cross-section such that socket opening 112 is hexagonal. Outer configuration 116 is also hexagonal. In the example illustrated, socket opening 112 has a ⅝ inch size for use in removing and installing spark plugs such as those primarily used for two cycle engines such as string trimmers, chainsaws and hedge trimmers. In other embodiments, such as those embodiments in which socket system 20 is not part of a spark plug tool, socket opening 112 may have other sizes and they have other inner configurations.

Figure 9:
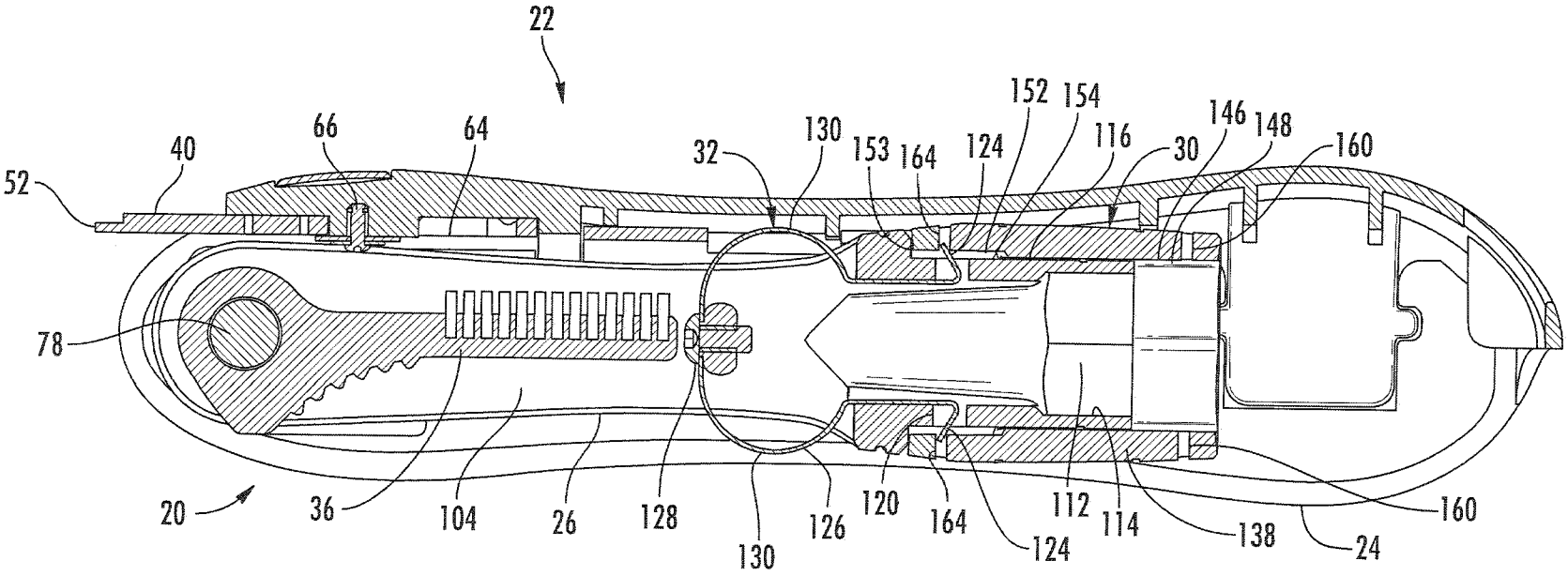
FIG. 9 is a sectional view of the spark plug tool and socket system of FIG. 1.
Figure 9A:
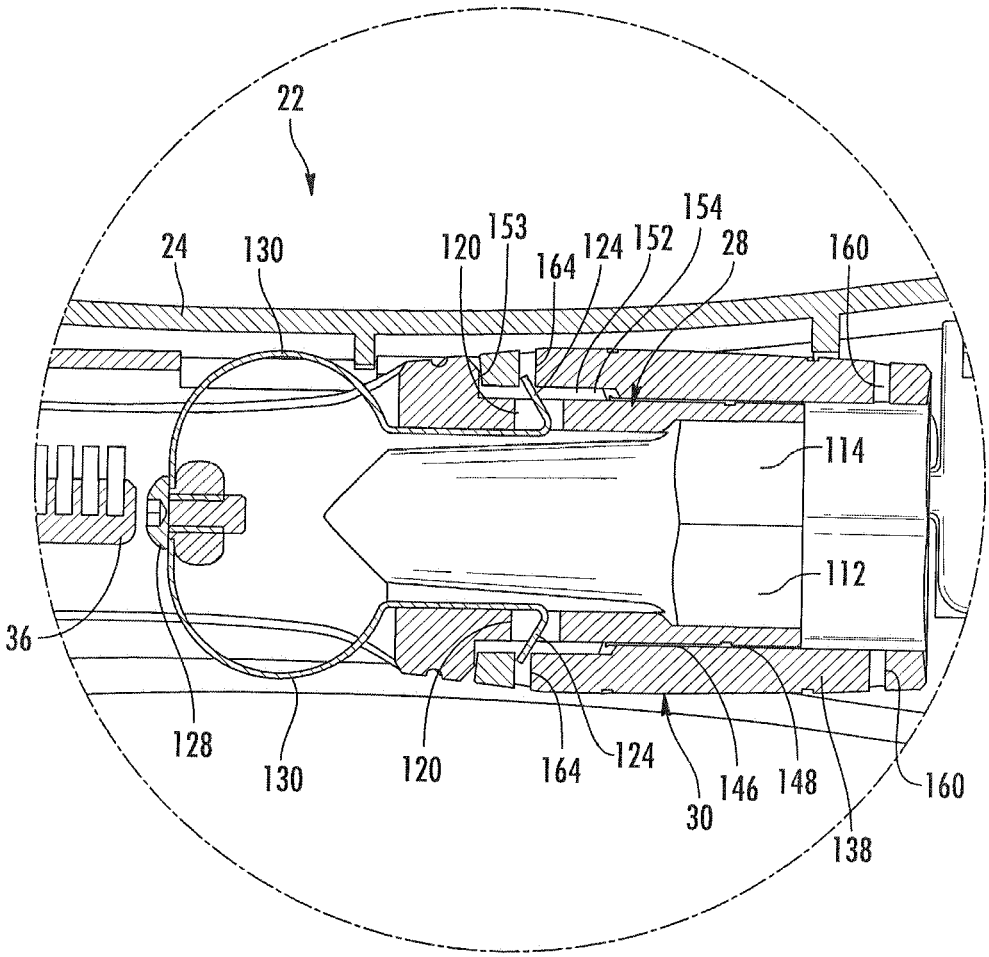
FIG. 9A is an enlarged fragmentary sectional view of the spark plug tool and socket system of FIG. 1.

As shown by FIGS. 8 and 9, walls 116 further include opposite openings 120 through which retainer 32 projects to engage socket 30 and releasably or removably retain the socket 30 on socket mount 28. FIG. 9 is a cross-sectional view of spark plug tool 22 taken along line 9-9 of FIG. 6. FIG. 9 illustrates each of extension 26 and implements 34-38 in nested positions within handle 24. FIG. 9 also illustrates gap gauge 40 in the retracted position. In addition, FIG. 9 illustrates retainer 32 retaining socket 30 on socket mount 28.

Retainer 32 assists in securing socket 30 on socket mount 28. In the example illustrated, retainer engages or contacts against an interior surface of wall 116 within socket opening 112. Although retainer is illustrated as extending within socket mount 28 and through socket mount 28 into contact with socket 30, in other embodiments, retainer 32 no alternative will he extend along an outer surface of socket mount 32.

Retainer 32 includes one of a detent and a projection, wherein socket 30 includes the other of the detent and the projection. The projection extends into the detent to axially retain socket 30 on socket mount 28. At least one of the projection and the detent are resiliently biased towards the other.

As shown by FIG. 9, in the particular example illustrated, retainer 32 is supported by extension 26 or socket mount 28 and includes a pair of projections 124 which project outwardly beyond walls 116 of socket mount 28 and into retaining engagement with socket 30. Retainer 32 further includes a bias 126 which resiliently biases projections 124 in a radially outward direction towards socket 30. In the example illustrated, bias 126 comprises a loop of resilient spring-like material, such as spring metal, secured to extension 26 by fastener 128. In the example illustrated, projections 124 and bias 126 are integrally formed as a single unitary body.

In other embodiments, projections 124 and bias 126 may have other configurations. For example, retainer 32 may include greater or fewer than two opposite projections 124. Projections 124 may have different spacings or angular relationships. Projects 124 may comprise structure elements distinct from bias 126. Instead of comprising prongs, projections 124 may alternatively comprise balls or other structures resiliently biasing projections 124 into engagement with socket 30. Bias 126 may include multiple separate structures that resiliently bias their associated projections 124. Bias 126 may comprise two or more leaf springs. Bias 126 may alternatively comprise one or more compression springs or tension springs.

As further shown by FIG. 9, retainer 32 includes manually accessible actuation surfaces 130 which allow the precedent of bias 126 to inwardly or radially move projections 124 out of engagement with socket 30. In the example illustrated in which bias 126 comprises a loop of resilient or spring-like material, bias 126 is disposed cavity 104 between arms 102 with rounded portions of bias 126 projecting beyond cavity 104 and beyond arms 102 to provide surfaces 130. In the example illustrated, bias 32 comprises a single integral light-weight structure providing each of projections 124, bias 126 and actuation sources 130, reducing complexity and cost while increasing compactness and ease-of-use. In other embodiments, manually accessible actuation surfaces for actuating or moving projections 124 against the biasing force of bias 126 may be provided by other structures formed as a part of or structurally distinct from projections 124 or bias 126.

Figure 10:
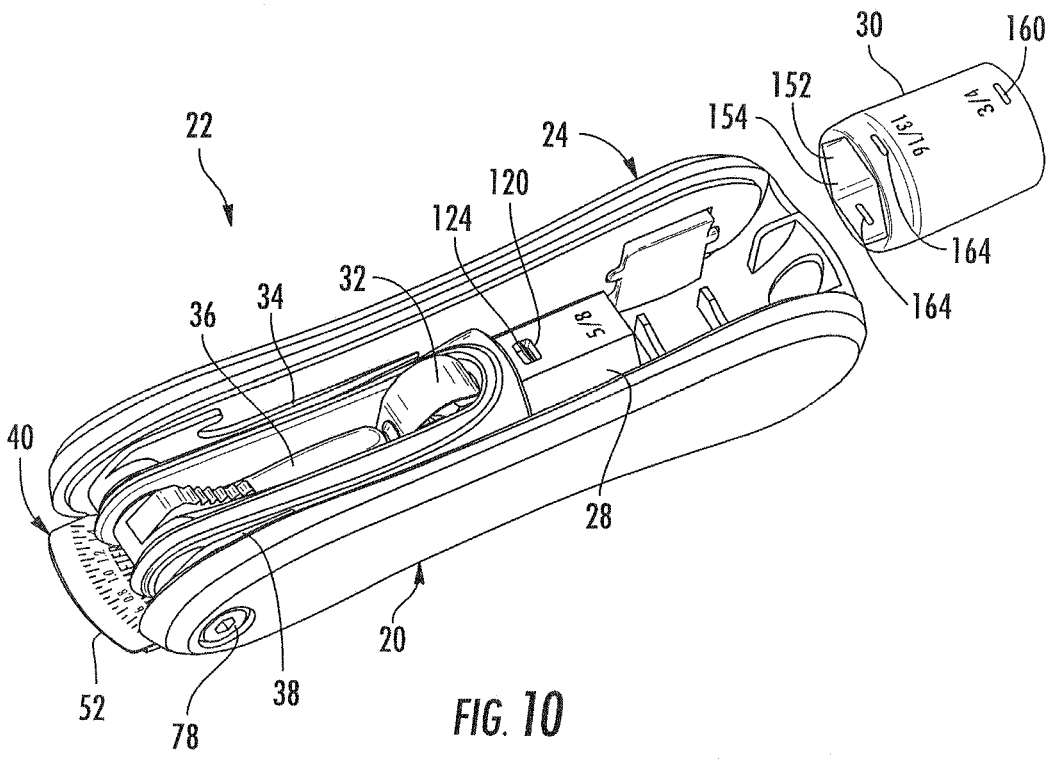
FIG. 10 is a bottom perspective view of the spark plug tool and socket system of FIG. 1 illustrating withdrawal of a socket from a remainder of the spark plug tool.
Figure 11:
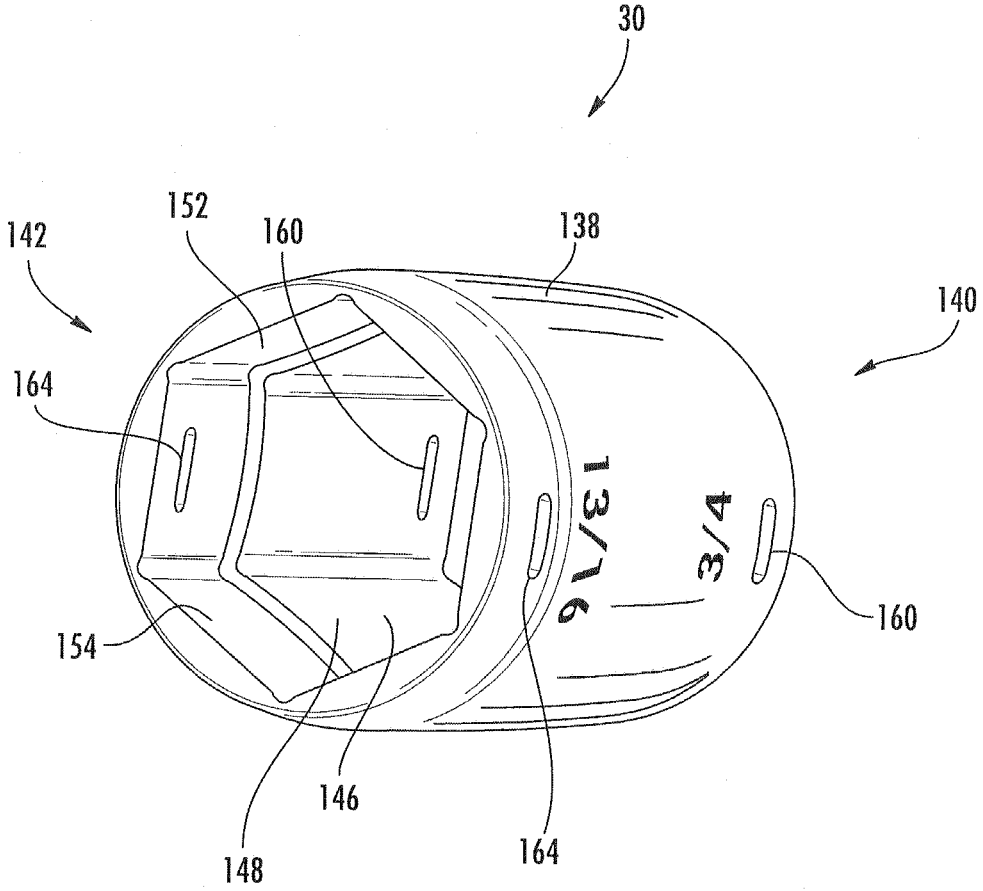
FIG. 11 is a perspective view of the socket of FIG. 10.
Figure 12:
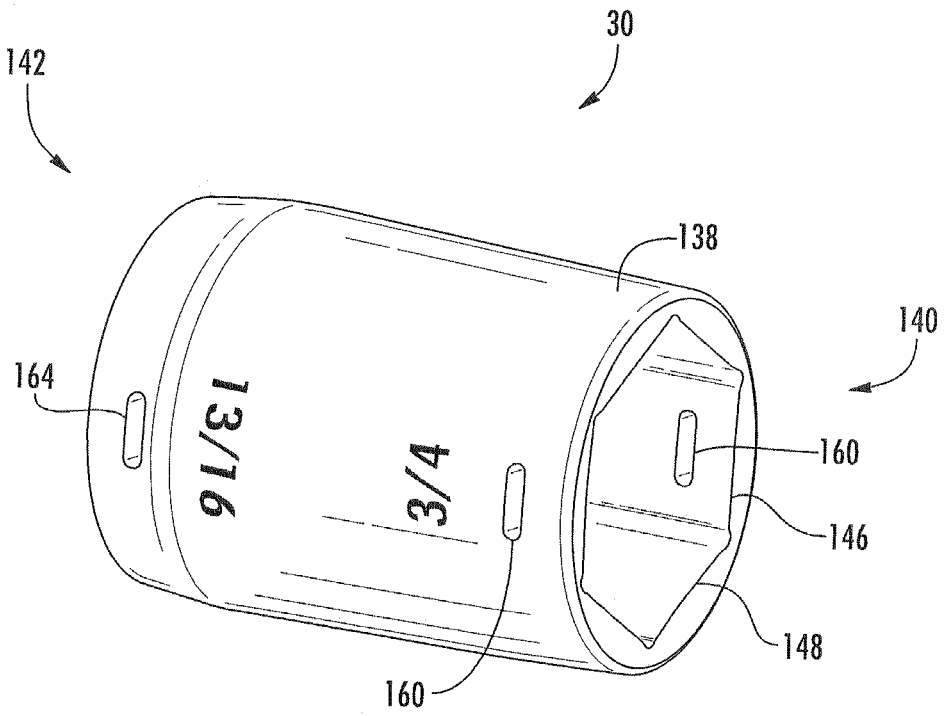
FIG. 12 is another perspective view of the socket of FIG. 10.
Figure 13:
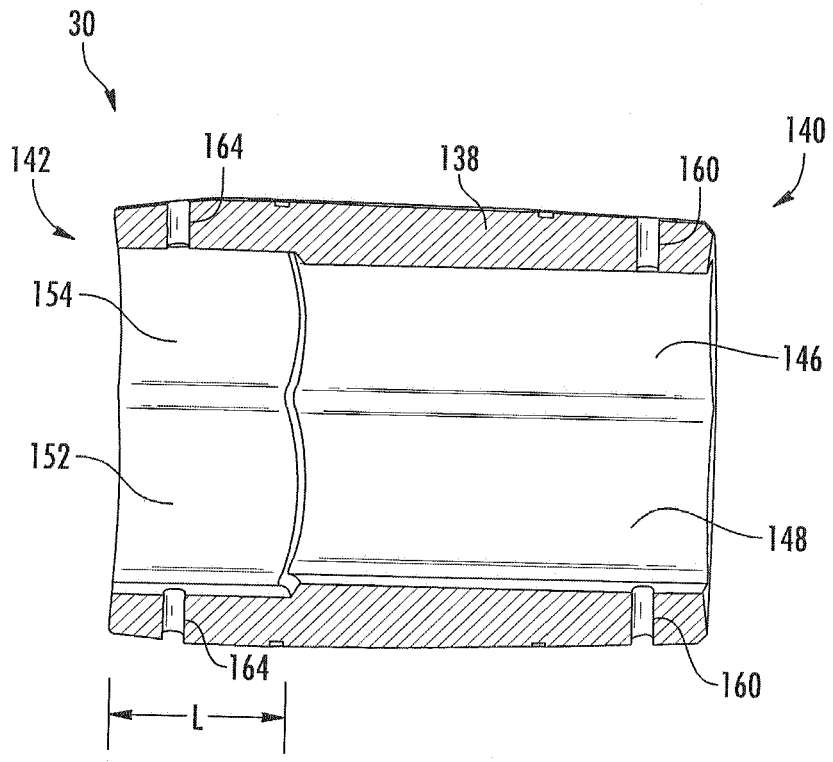
FIG. 13 is a sectional view of the socket of FIG. 10.

As shown by FIG. 10, depressment or squeezing of actuation surfaces 130 towards one another also moves the opposite projections 124 towards one another to withdrawn positions radially out of engagement with socket 30, allowing socket 30 to be axially withdrawn and moved off of socket mount 28. FIGS. 11-13 illustrate socket 30 in more detail. As shown by such figures, socket 130 includes one or more walls 138 forming socket 130 which has opposite portions or ends 140 and 142.

At end 140, the one or more walls 1384 are defined a socket opening 146 and have a first inner configuration 148. Socket opening 146 is sized to receive socket mount 30 (shown in FIG. 8). Inner configuration 148 corresponds to the outer configuration 116 of socket mount 30. In the example illustrated, socket opening 146 and inner configuration 148 are substantially similar to the outer size of socket mount 30 and its outer configuration 116 such that there is sufficient mating contact such that socket mount 28 and socket 30 may be rotated in unison with one another as torque is transmitted across socket mount 28 and socket 32 to a spark plug or other structure being rotated. In the example illustrated, the inner configuration 148 of socket opening 146 comprises a ¾ inch hexagonal configuration, having an opening of about 25/32 of an inch from one face to an opposite face, allowing socket opening 146 to receive and turn spark plugs primarily used for four cycle engines such as push mowers, lawn tractors, edgers, tillers, pressure washers and the like. Accordingly, the outer configuration 116 of socket mount 28 is hexagonal and is ¾ of an inch from one face to an opposing face.

At end of 142, the one or more walls 138 of socket 30 form a socket opening 152 having an inner configuration 154. Socket opening 152 is sized differently than socket opening 146. In the example illustrated, inner configuration 154 is the same as the inner configuration 148 in that both configurations are hexagonal. Socket opening 152 comprises a 13/16 inch hexagonal socket opening configured to receive a 13/16 of an inch hexagonal structure. In particular, socket opening 152 having an opening of about 27/32 of an inch from one face to an opposite face, allowing socket opening 146 to receive and turn spark plugs primarily used for four cycle engines such as push mowers, lawn tractors, edgers, tillers, pressure washers and the like.

Because socket 30 includes openings 146 and 152 which are differently sized so as to receive and accommodate different spark plug hex sizes, socket 30 provide spark plug tool 22 with greater versatility, allowing spark plug tool 22 to remove or install differently sized spark plugs on different engines on different equipment. When changing, removing or installing differently sized spark plugs on different pieces of equipment, a person merely needs to withdraw socket 30 socket mount 28 and flip socket 30 prior to reinstalling socket 30 on to socket mount 28. In the example illustrated, because socket mount 28 itself includes an inner configuration 114 providing yet a third sized socket opening 112, socket tool 22 is provided with even greater versatility, being able to accommodate three different sparkplug hex sizes. In some embodiments, spark plug mount 28 may omit socket opening 112 such that spark plug tool 22 accommodates two different spark plug hex sizes. In embodiments where socket system 20 is utilized as part of other tools or for other applications, socket openings 112, 146 and 152 as well as inner configurations 114, 148 and 154 may have different configurations and sizes.

As shown by FIG. 13, socket opening 152 opens into socket opening 146. At the same time, socket opening 152 has an axial length L less than an axial length of socket mount 30. As a result, when socket opening 146 is to be used, socket mount 28 may extend through socket opening 152 into socket opening 146 as shown by FIG. 9. Because socket mount 28 is able to extend completely through socket opening 152 into the smaller sized socket opening 146, socket mount 28 more closely mates or snugly fits within socket 30, reducing slop, relative movement or play between socket mount 28 and socket 30 as socket 30 is being rotated.

A further shown by FIGS. 9 and 11, socket 30 includes opposite detents 160 extending at least partially into wall 138 radially outward from socket opening 146. Detents 160 comprise openings, cavities or depressions sized and configured to receive projections 124 of retainer 32 when end 142 of socket 30 is being used and when end 140 is abutted against shoulder 153 of socket mount 28. As a result, socket 30 is axially retained on socket mount 28 when end 142 of socket 30 is being used.

Socket 30 further includes opposite detents 164 extending at least partially into wall 138 radially outward from socket opening 152. Detents 164 comprise openings, cavities or depressions sized and configured to receive projections 124 of retainer 32 when end 140 of socket 30 is being used and when end 142 is abutted against shoulder 153 of socket mount 28. As a result, socket 30 is axially retained on socket mount 28 when end 140 of socket 30 is being used. Consequently, socket mount 30 may be maintained within the smaller more closely fitting socket opening 146 when end 140 is being used.

In the example illustrated, each of detents 160, 154 comprise openings completely extending through the water more walls 138. In other embodiments, detents or 150, 154 may comprise notches or other cavities only partially extending into and not completely through the one or more walls 138. In still other embodiments, a greater or fewer of such detents 160 or a greater or fewer of such detents 164 may be provided proximate to end 140 and end 142 of socket 30, respectively. In some embodiments, detents 160 or detents 164 may be omitted, wherein retention of socket 30 on socket mount 28 relies upon frictional contact between projections 124 and the inner surfaces of socket openings 146 and 152. In yet other embodiments, detents 160 may be omitted while detents 164 are provided. In such an embodiment, detents 164 cooperate with projections 124 to reduce the likelihood of a larger or wider socket opening 152 from slipping off of socket mount 28. In yet other embodiments, retainer 32 as well as detents 160, 164 may be omitted.

Figure 14:
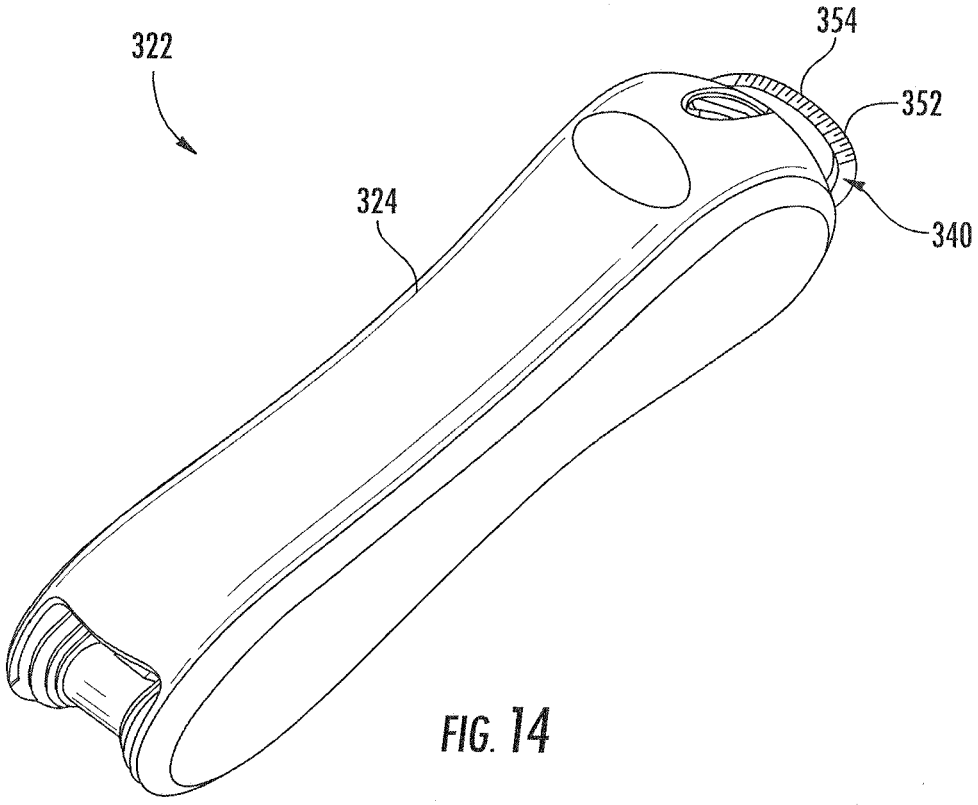
FIG. 14 is a perspective view of another embodiment of the spark plug tool of FIG. 1 according to an example embodiment.
Figure 15:
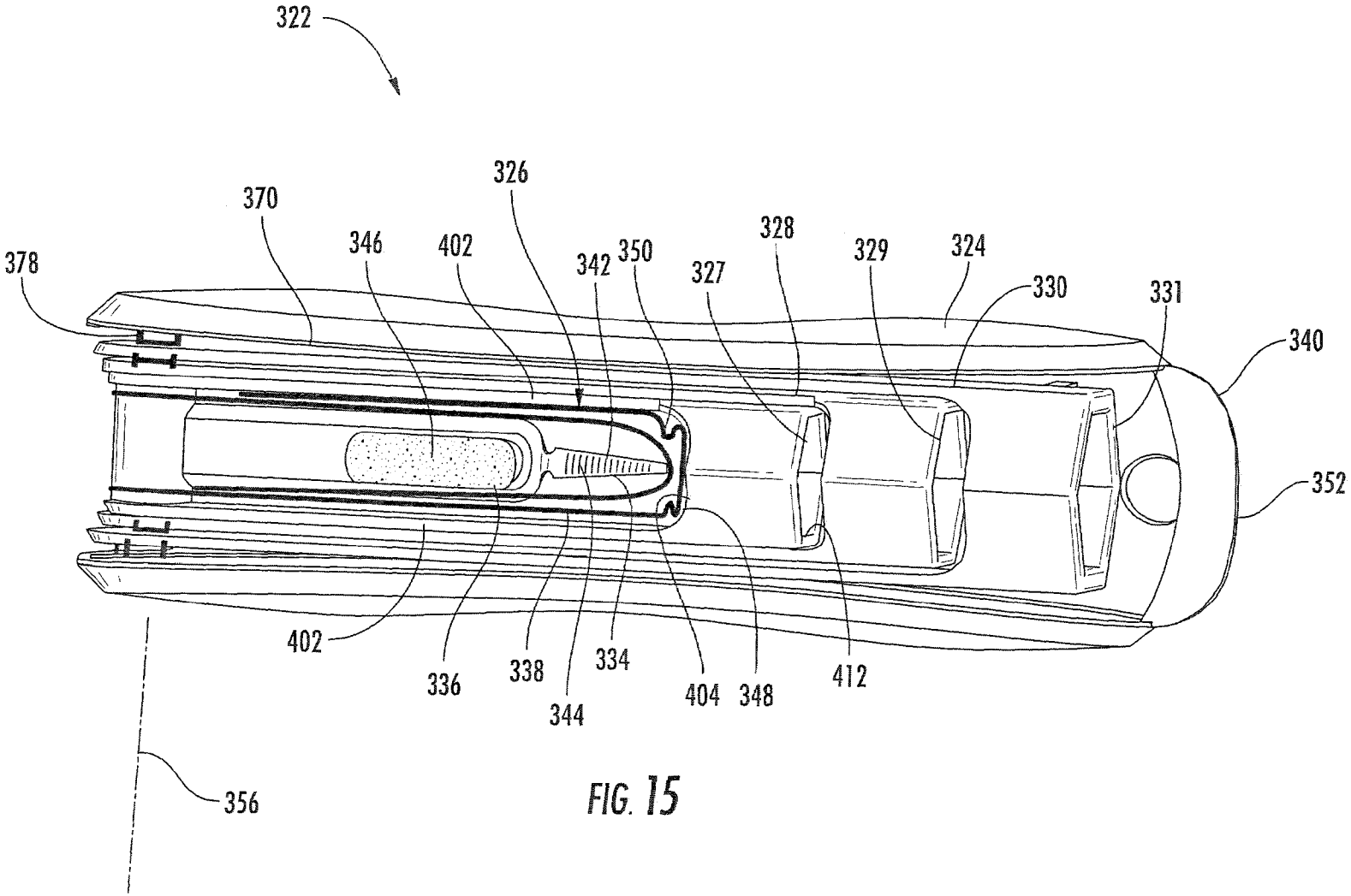
FIG. 15 is a bottom plan view of the spark plug tool of FIG. 14.

FIGS. 14-20 illustrate spark plug tool 322, another embodiment of spark plug tool 22. As with spark plug tool 22, spark plug tool 322 includes sparkplug implements and a socket opening carried by an extension, wherein the implements and the socket opening each move between an extended position extending from the handle and a nested position within the handle. Spark plug tool 322 includes handle 324, extension 326 carrying socket opening 327, extension 328 carrying socket opening 329, extension 330 carrying socket opening 331, scraper 334, brush 336, gap adjuster 338 and gap gauge 340. As shown by FIG. 15, handle 324 includes an interior cavity 370 into which extension 326 carrying socket opening 327, extension 328 carrying socket 329, extension 330 carrying socket 331, scraper 334, brush 336 and gap adjuster 338 nest. In the example illustrated, handle 324 includes a pivot shaft or bolt 378 extending along the axis 356 and about which socket 327, extension 328 carrying socket 329, extension 330 carrying socket 331, scraper 334 and brush 336 pivot.

Extensions 326, 328 and 330 extend between shaft 378 and their associated sockets 327, 329 and 331. Each extension 326, 328 and 330 comprises a pair of spaced apart arms 402 which form an interior cavity 404. As shown by FIG. 15, cavity 404 receives at least one of spark plug implements 334 and 336. In addition, the cavity 404 of extension 328 nestably receives extension 326 and its socket 327. The cavity 404 of extension 330 nestably receives extension 128 and its socket 329. As a result, spark plug tool 322 is even more compact.

In other embodiments, other spark plug implements or additional spark plug implements may nest within each cavity 404. In yet other embodiments, each cavity 404 may have other configurations. For example, in other embodiments, a panel may bridge between and across arms 402 such that cavity 404 is enclosed on three sides. In yet other embodiments, spark plug implements 334, 336 or other implements may alternatively extend to one side or another side of each of extensions 326, 328, 330.

Sockets 327, 229 and 331 are each differently sized having differently sized socket openings. The socket 327 has a socket opening 412 comprising a ⅝ inch diagonal socket opening, configured to receive a ⅝ inch hex shape. The socket 329 has a socket opening 446 comprising a ¾ inch diagonal socket opening, configured to receive a ¾ inch hex shape. The socket 329 has a socket opening 452 comprising a 13/16 inch diagonal socket opening, configured to receive a 13/16 inch hex shape. As a result, spark plug tool 322 may accommodate multiple differently sized sparkplug hex shapes.

Although spark plug tool 322 is illustrated as having the aforementioned three sockets, In other embodiments, spark plug tool 322 may include a greater or fewer of such sockets. In addition, the sockets may have differently sized as well as different configured socket openings. Although sockets 327, 329 and 331 are illustrated as being integrally formed as a single unitary body with their associated extensions 326, 328 and 330, respectively, in other embodiments, one or more of such sockets may alternatively be removably connected to their associated extensions such as with socket mounts similar to socket mount 28 described above. In such embodiments, each of such sockets may have two ends, each end providing a differently sized and/or configured socket opening. For example, each socket may be configured similar to socket 30 described above, providing a tool with up to six differently sized socket openings. In some embodiments, the nesting arrangement of extensions and sockets may be used in tools for uses outside or beyond the installation, removal or servicing of spark plugs.

Scraper 334, brush 336 and gapping gauge 340 facilitate the inspection, adjustment, tuning and servicing of a spark plug. Scraper 334 includes an edge 342 and a serrated or roughened face 344 to assist in the removal of carbon. Brush 336 includes metal or brass wires 346 to facilitate the cleaning of electrodes and threads. Adjuster 338 includes differently sized notches 348, 350, each notch sized for receiving a differently sized ground electrode and for bending and repositioning the ground electrode with respect to an opposite center electrode of the spark plug so as to adjust the gap between the ground electrode and the center electrode.

Gap gauge 340 comprises a coin-style gauge having an edge 352 that continuously and smoothly becomes thicker from a first end to an opposite second end with associated thickness identifying markings 354 (shown in FIG. 14). In other embodiments, other spark plug implements may be provided as part of spark plug tool 322. For example, in place of a coin style gap gauge 340, spark plug tool 322 may alternatively include one or more wire gauges or other gauging mechanisms. In still other embodiments, one or more of such spark plug implements may be omitted.

Figure 15A:
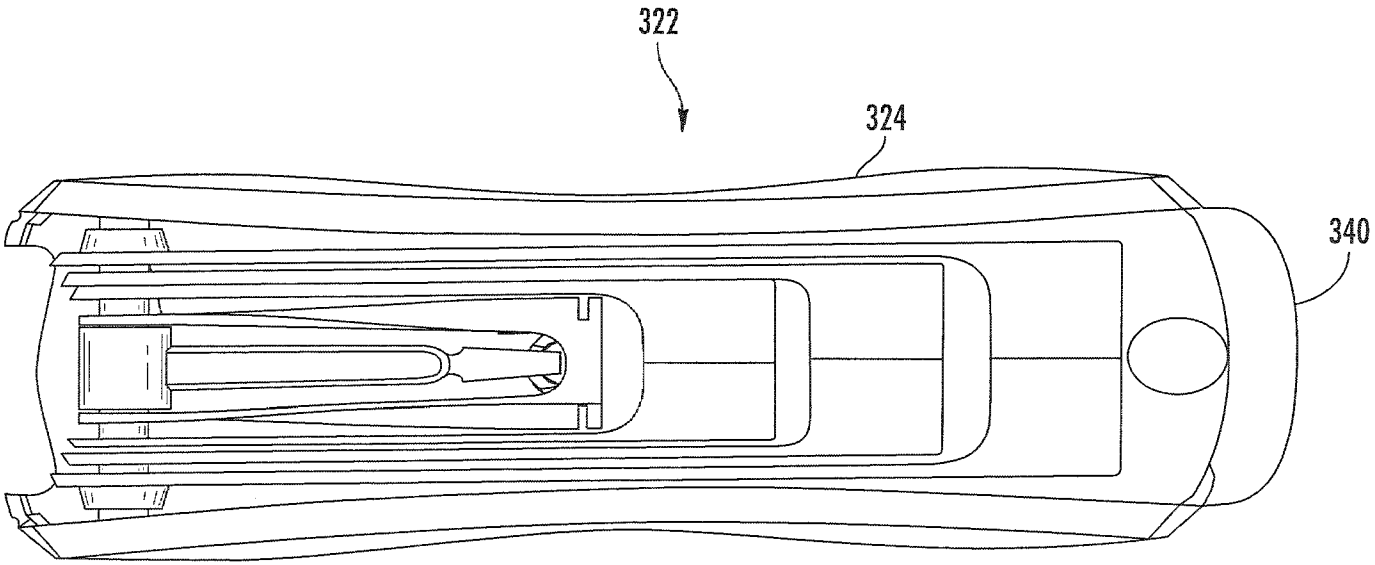
FIG. 15A is another bottom plan view of the spark plug tool of FIG. 15.
Figure 16:
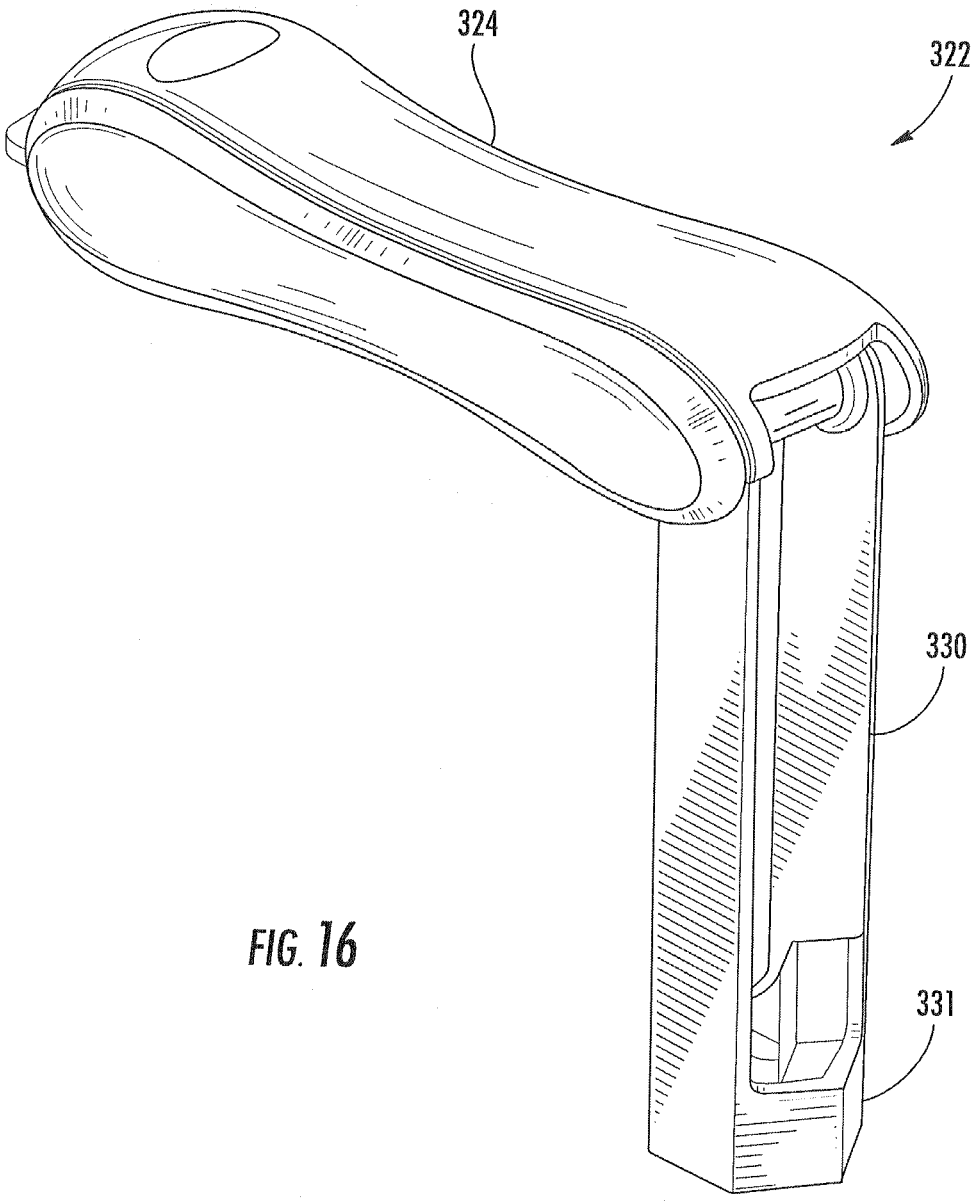
FIG. 16 is a perspective view of the spark plug tool of FIG. 14 illustrating extension of a first extension of the spark plug tool.
Figure 17:
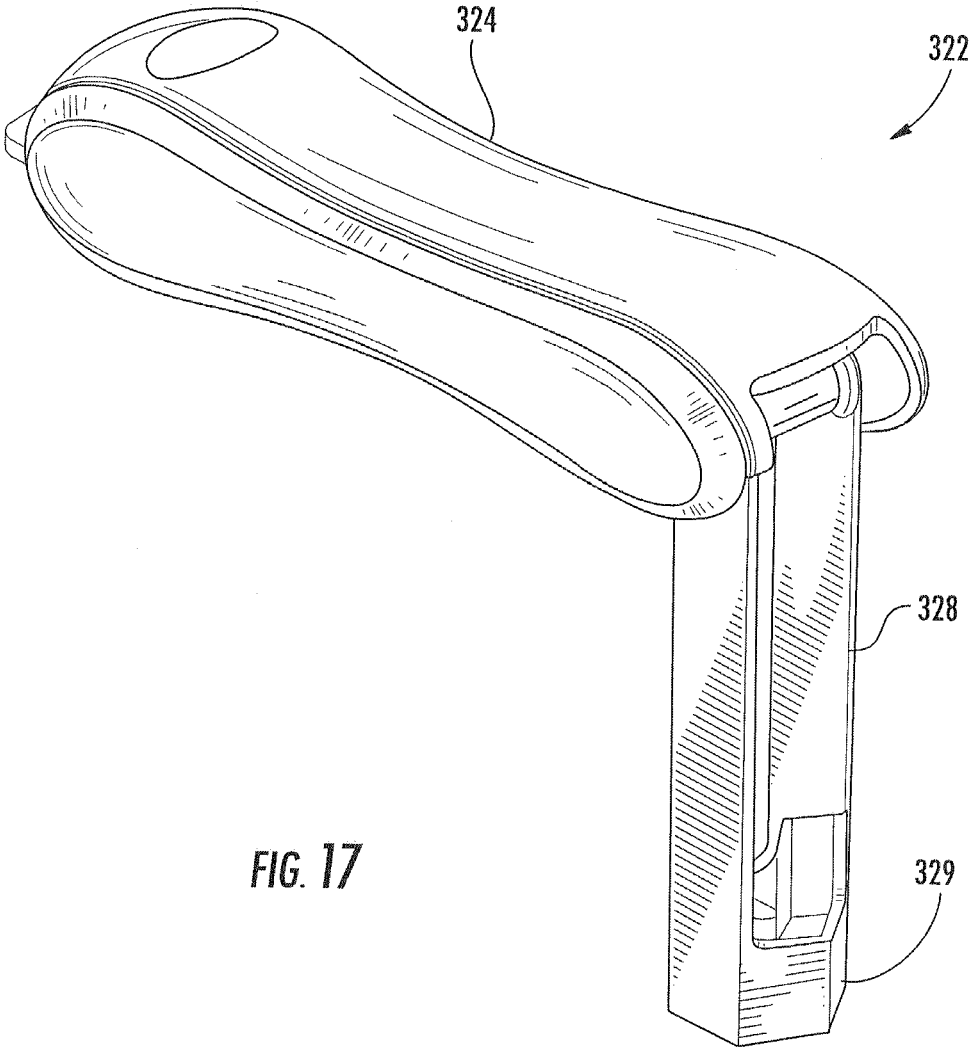
FIG. 17 is a perspective view of the spark plug tool of FIG. 14 illustrating extension of a second extension of the spark plug tool.
Figure 18:
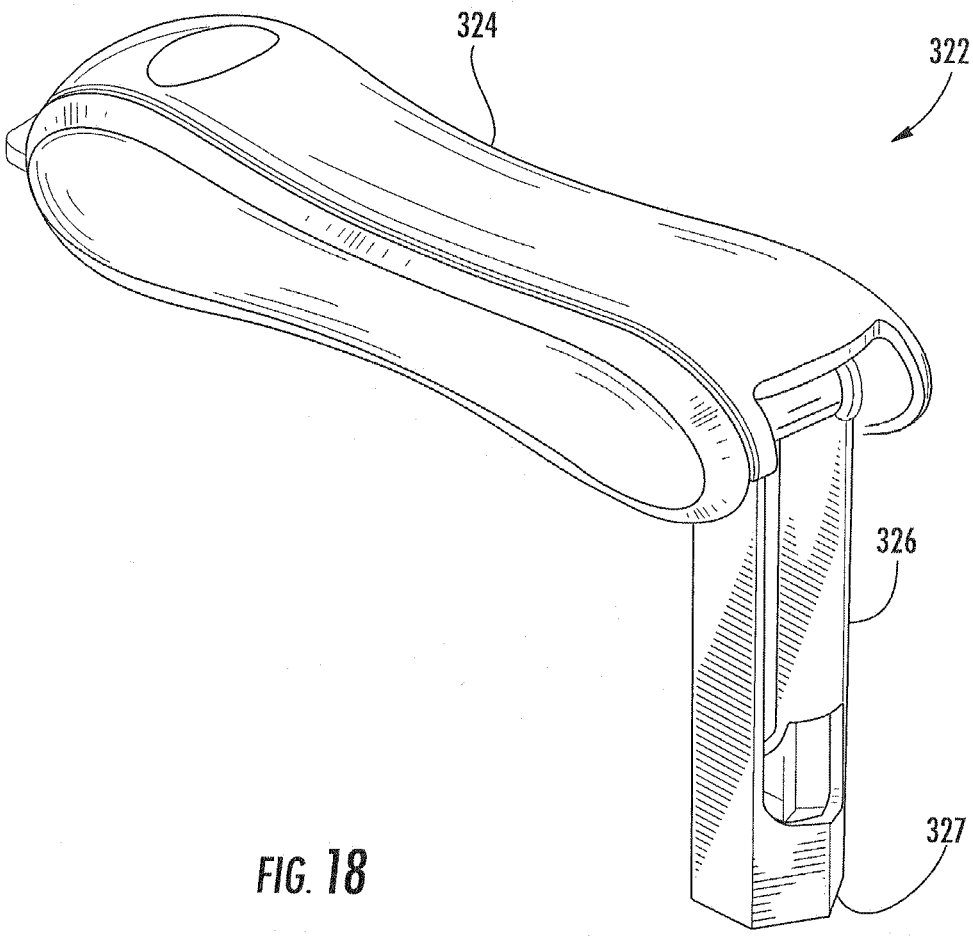
FIG. 18 is a perspective view of the spark plug tool of FIG. 14 illustrating extension of a third extension of the spark plug tool.
Figure 19:
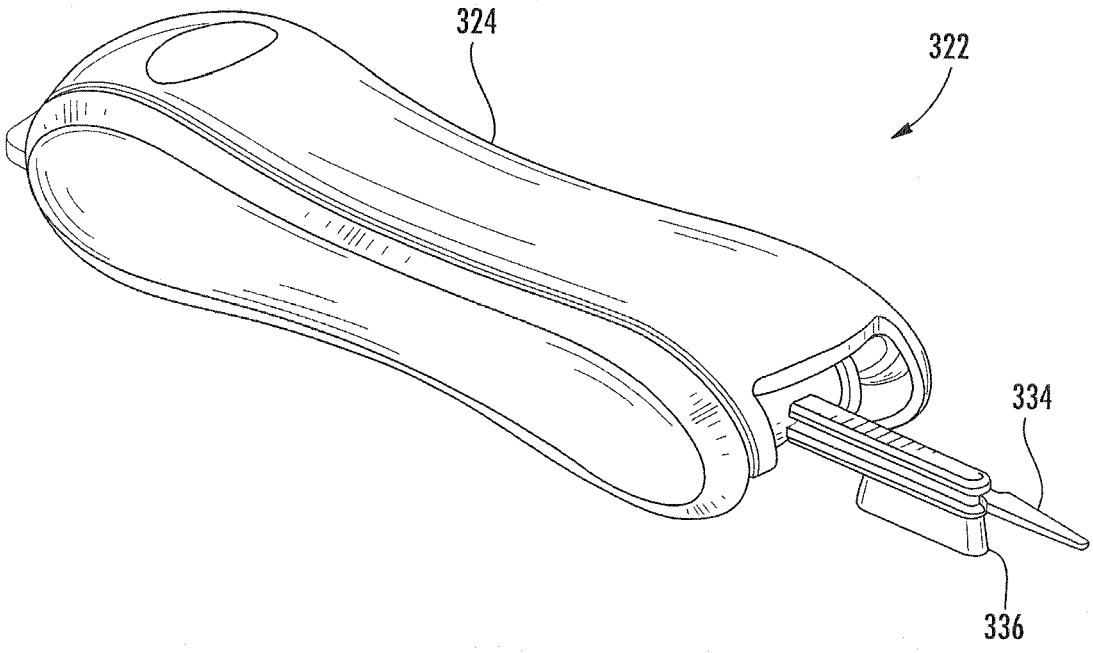
FIG. 19 is a perspective view of the spark plug tool of FIG. 14 illustrating extension of a scraper and brush of the spark plug tool.
Figure 20:
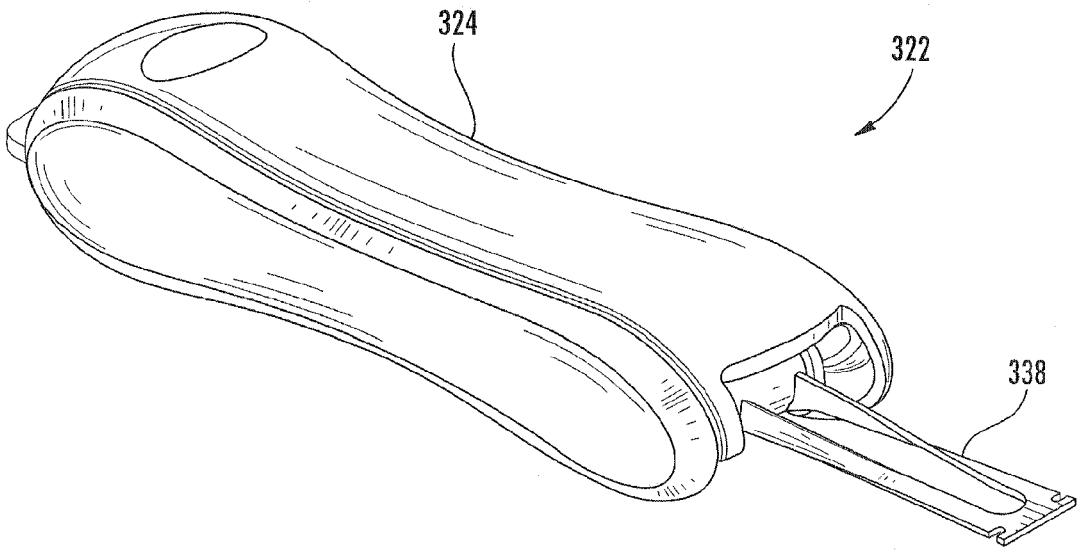
FIG. 20 is a perspective view of the spark plug tool of FIG. 14 illustrating extension of a gap adjuster of the spark plug tool.

FIGS. 16-20 illustrate extension 326 carrying socket opening 327, extension 328 carrying socket 329, extension 330 carrying socket 331, scraper 334, brush 336 and gap adjuster 338 prevented from their nested position shown in FIGS. 15 and 15A to extended positions, respectively, available for use.

Although the present disclosure has been described with reference to example embodiments, workers skilled in the art will recognize that changes may be made in form and detail without departing from the spirit and scope of the below defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

The invention claimed is:

1. A socket system comprising:

a socket having a first end and a second end, the first end having a first socket opening having a first inner configuration, the second end having a second socket opening having a second inner configuration different than the first inner configuration;

a tool having a socket mounting end, the socket mounting end having an outer configuration corresponding to the first inner configuration and a third socket opening having a third inner configuration, wherein the first inner configuration is smaller than the second inner configuration and wherein the second socket opening opens into the first socket opening, permitting the socket mounting end to project through the second socket opening into the first socket opening.

2. The socket system of claim of 1, wherein the first inner configuration opens into the second inner configuration.

3. The socket system of claim 1, wherein the first inner configuration is a first sized hexagonal configuration and where the second inner configuration is a second sized hexagonal configuration.

4. The socket system of claim 1 further comprising a first detent extending from the first inner configuration.

5. The socket system of claim 4 further comprising a second detent extending from the second inner configuration.

6. The socket system of claim 4, wherein the first detent extends through the first end.

7. The socket system of claim 4 further comprising a second detent extending from the first inner configuration on an opposite side of the first inner configuration.

8. The socket system of claim 1, wherein the socket mounting end includes a shoulder configured to abut a first axial end of the socket where the first socket opening of the socket is proximal the socket mounting end.

9. The socket system of claim 8, wherein the shoulder is configured to abut a second axial end of the socket when the second socket opening of the socket is proximal the socket mounting end.

10. The socket system of claim 1 further comprising:

a detent carried by one of the socket and the socket mounting end; and a projection carried by the other of the socket and the socket mounting end, wherein the projection projects into the detent to retain the socket on the socket mounting end and wherein at least one of the projection and detent are resiliently biased into socket retaining engagement.

11. The socket system of claim 10, wherein the detent is in a side of the socket and wherein the projection is carried by the socket mounting end and is resiliently biased into the detent.

12. The socket system of claim 10 further comprising a first detent extending from the first inner configuration.

13. The socket system of claim 12 further comprising a second detent extending from the second inner configuration.

14. The socket system of claim 12, wherein the first detent extends through the first end.

15. The socket system of claim 12 further comprising a second detent extending from the first inner configuration on an opposite side of the first inner configuration.

16. The socket system of claim 1, wherein the first inner configuration is a first sized hexagonal configuration, where the second inner configuration is a second sized hexagonal configuration and wherein the third inner configuration is a third sized hexagonal configuration.

17. The socket system of claim 1, wherein the tool further comprises:

a handle; and one or more spark plug implements selected from a group of spark plug implements consisting of: a scraper; a brush; a gapping gauge and a gapping implement, wherein each of the one or more spark plug implements and the socket mounting end nest within the handle.

18. The socket system of claim 17, wherein the socket nests within the handle while mounted on the socket mounting end.

19. The socket system of claim 17 further comprising an extension extending from the handle and terminating at the socket mounting portion, wherein at least one of the one or more spark plug implements nests within the extension.

20. The socket system of claim 17, wherein each of the one or more spark plug implements and the socket mounting end independently pivot between an extended position extending from the handle and a nested position within the handle.

21. The socket system of claim 1 further comprising a spark plug gauge and gapping implement, wherein spark plug gauge and gapping implement slides between an extended position projecting from the handle by a first extent and a refracted position extending from the handle by a second extent less than the first extent.

22. A socket system comprising:

a socket having a first end and a second end, the first end having a first socket opening having a first inner configuration, the second end having a second socket opening having a second inner configuration different than the first inner configuration;

a tool having a socket mounting end, the socket mounting end having an outer configuration corresponding to the first inner configuration and a third socket opening having a third inner configuration, wherein the socket mounting end includes a shoulder configured to abut a first axial end of the socket where the first socket opening of the socket is proximal the socket mounting end, wherein the shoulder is configured to abut a second axial end of the socket when the second socket opening of the socket is proximal the socket mounting end.

23. A socket system comprising:

a socket having a first end and a second end, the first end having a first socket opening having a first inner configuration, the second end having a second socket opening having a second inner configuration different than the first inner configuration;

a tool having a socket mounting end, the socket mounting end having an outer configuration corresponding to the first inner configuration and a third socket opening having a third inner configuration;

a detent carried by one of the socket and the socket mounting end; and a projection carried by the other of the socket and the socket mounting end, wherein the projection projects into the detent to retain the socket on the socket mounting end and wherein at least one of the projection and detent are resiliently biased into socket retaining engagement, wherein the detent is in a side of the socket and wherein the projection is carried by the socket mounting end and is resiliently biased into the detent.

* * * * *